United States Patent [19]

Gründler

[11] 4,365,459

[45] Dec. 28, 1982

[54] APPARATUS FOR PRODUCING BAG PACKAGES

[75] Inventor: Bruno Gründler, Neuhausen am Rheinfall, Switzerland

[73] Assignee: SIG - Schweizerische Industrie-Gesellschaft, Neuhausen am Rheinfall, Switzerland

[21] Appl. No.: 221,446

[22] Filed: Dec. 30, 1980

[30] Foreign Application Priority Data

Jan. 4, 1980 [CH] Switzerland ..... 37/80

[51] Int. Cl.[3] ..... B65B 9/08; B65B 41/14

[52] U.S. Cl. ..... 53/552; 53/389; 493/302; 493/197; 493/252

[58] Field of Search ..... 53/550, 551, 552, 553, 53/554, 575, 576, 389; 493/193, 196, 201, 203, 302, 250, 252, 936, 175, 95

[56] References Cited

U.S. PATENT DOCUMENTS

| | | | |
|---|---|---|---|
| 2,923,115 | 2/1960 | Frank | 53/551 |
| 3,146,565 | 9/1964 | Otto | 53/575 |
| 3,543,477 | 12/1970 | Leasure | 53/551 |
| 3,552,081 | 1/1971 | Leasure | 53/552 |
| 3,910,013 | 10/1975 | Babineau | 53/291 |
| 3,973,474 | 8/1976 | Auckenthaler | 493/197 |
| 4,079,662 | 3/1978 | Puccetti | 493/203 |
| 4,129,976 | 12/1978 | Gründler | 53/552 |

FOREIGN PATENT DOCUMENTS

| | | |
|---|---|---|
| 1511636 | 2/1971 | Fed. Rep. of Germany . |
| 7536485 | 12/1976 | Fed. Rep. of Germany . |
| 385091 | 2/1965 | Switzerland . |

*Primary Examiner*—Horace M. Culver
*Assistant Examiner*—Kurt Rowan
*Attorney, Agent, or Firm*—Spencer & Kaye

[57] ABSTRACT

In apparatus for producing bag packages and including a shaping mandrel presenting a shaping surface and a longitudinal seal forming device for forming a panel of sealable material into a tube and transverse sealing jaws and severing blades for dividing the tube into individual bags, the mandrel includes members defining two carriages mounted at diametrically opposite sides of the mandrel and forming at least in part the shaping surface of the mandrel, and there are further provided clamping members each mounted to face a respective carriage and to be moved toward the shaping mandrel to press the tube against the carriages and thus clamp the tube, and elements connecting the carriages and clamping members together for movement in unison in the longitudinal direction of the mandrel.

10 Claims, 7 Drawing Figures

APPARATUS FOR PRODUCING BAG PACKAGES

BACKGROUND OF THE INVENTION

The present invention relates to bag package forming apparatus of the type including a mandrel about which a panel of packaging material is formed into a tube, and elements for forming bags and severing each bag from the end of the tube.

One known apparatus of this type is disclosed in Swiss Published Patent Application No. 385,091. Although this device utilizes two panels for producing the bags, it is of course also well known to produce bags from only one panel. However, both types of manufacture incur the same problem, namely the advancement of the tube at or near the just shaped bag.

In the device disclosed in the above-mentioned patent, clamping jaws are displaceably arranged next to a shaping mandrel and as an extension of the jacket face so as to grip the tube at the two edge ribs formed by sealing together the two panels and pull the tube forward. If no such edge ribs exist, provision is made for at least the lowermost edge section of the shaping mandrel to be displaceable. In this arrangement, the clamping jaws press the tube against the shaping mandrel and the entire structure, thus compressed, is moved downwardly. For use of the simpler machinery, the bags must have edge ribs, which entails waste of paper or foil.

Without such edge ribs, the entire hollow mandrel must be moved downwardly. The next bag can thus be sealed transversely only after the entire displacement device has again reached its starting position. This causes a time delay in that it requires an additional process step or, if the sealing jaws were also moved downwardly, a large mass would have to be moved which would also be a drawback for the process sequence.

According to German Gebrauchsmuster [Utility Model Patent] No. 7,536,485, the tube is moved downwardly on oppositely disposed side faces of an endless belt. The drawback here is that this advancement is difficult to synchronize so that the tube may be bent.

German Pat. No. 1,511,636 discloses pulling the bag downwardly by means of the transverse sealing jaws. The countersupport is a sleeve over the shaping mandrel which is moved by means of a rod assembly in grooves of the shaping mandrel together with the sealing jaws. Therefore, the mass that must be moved back and forth is quite considerable.

SUMMARY OF THE INVENTION

It is an object of the present invention to provide the capability of moving such a tube downwardly after the transverse seal has been formed and the bag has been filled, without bending of the tube or requiring large masses for guidance.

The above and other objects are achieved, according to the present invention, in apparatus for producing bag packages and including a shaping mandrel presenting a tube shaping surface and a longitudinal seal forming device for forming a panel of sealable material into a tube and transverse sealing jaws and severing blades for dividing the tube into individual bags, by including in the mandrel elements defining two carriages mounted at diametrically opposite sides of the mandrel and forming at least in part the shaping surface of the mandrel, and providing clamping members each mounted to face a respective carriage and to be moved toward the shaping mandrel to press the tube against the carriages and thus clamp the tube, and elements connecting the carriages and clamping members together for movement in unison in the longitudinal direction of the mandrel.

DESCRIPTION OF THE PREFERRED EMBODIMENTS

Figure 1:
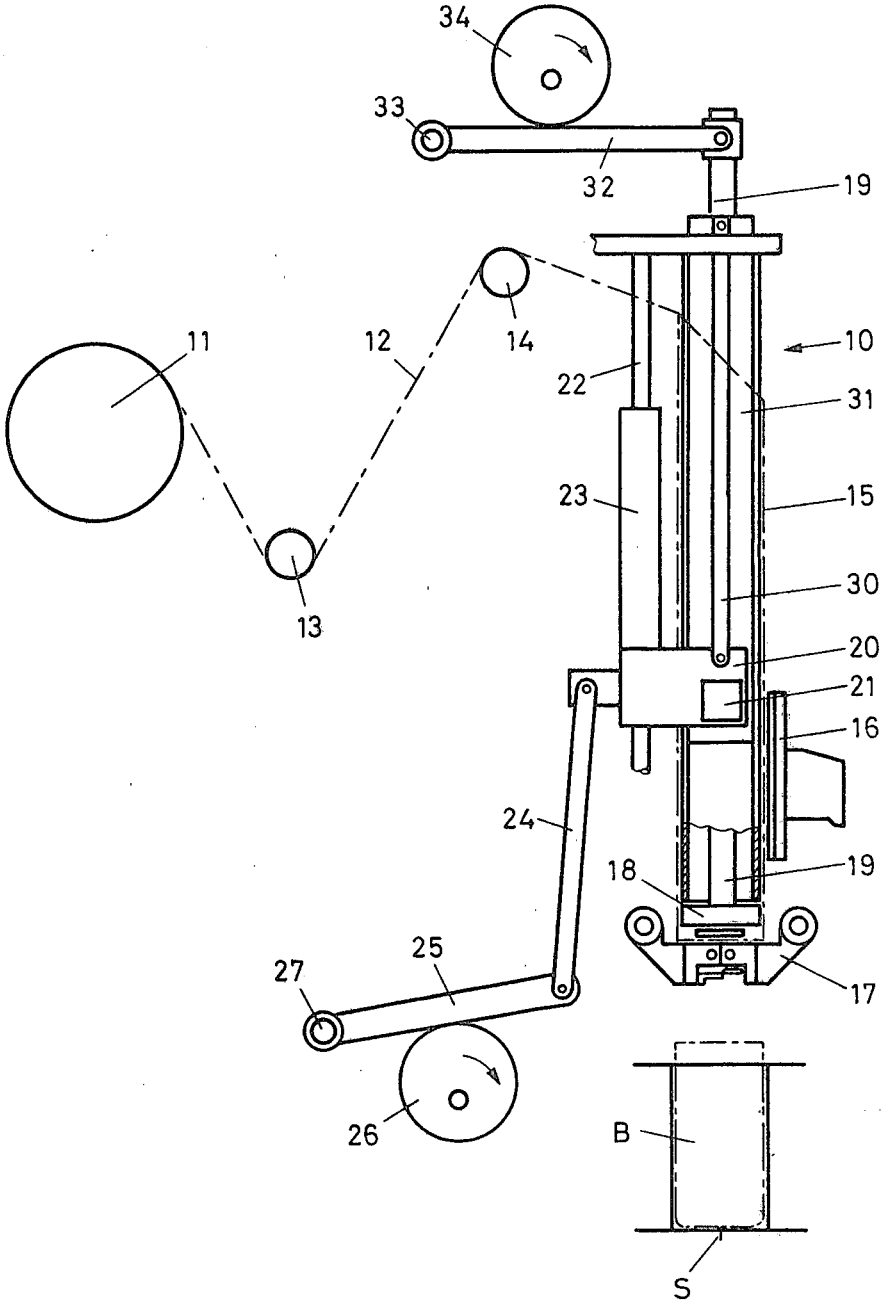
FIG. 1 is a schematic front elevational view of a preferred embodiment of apparatus according to the invention.

The apparatus for producing bag packages shown in FIG. 1 includes a shaping mandrel 10 having a rectangular cross section, over which a panel of foil 12, supplied over guide rollers 13 and 14 from a roll 11, is shaped into a tube 15. By means of a device 16 for producing a longitudinal seal, the connecting seam forming the tube is made tight, for example by means of heated sealing jaws, if the materials employed for panal 12 are thermosealable materials.

In the interior of the shaping mandrel 10 there is disposed a vertically movable stamp 18 which is useful for shaping the bottom of each bag B and which is moved up and down via a connected stamp rod 19 by means of a lever 32 which is pivotally fastened to a stationary bearing 33 and is moved by an eccentric disc 34.

Figure 5:
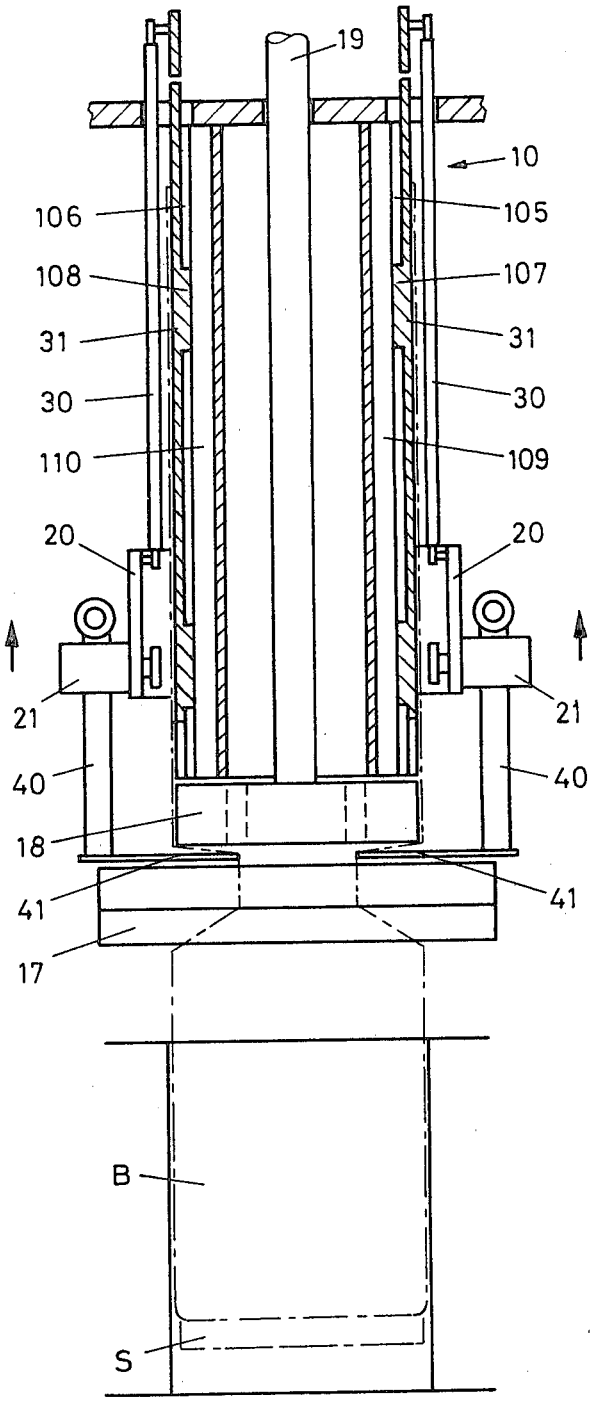
FIGS. 5 and 6 are views similar to those of FIGS. 3 and 4 of a second embodiment according to the invention.
Figure 6:
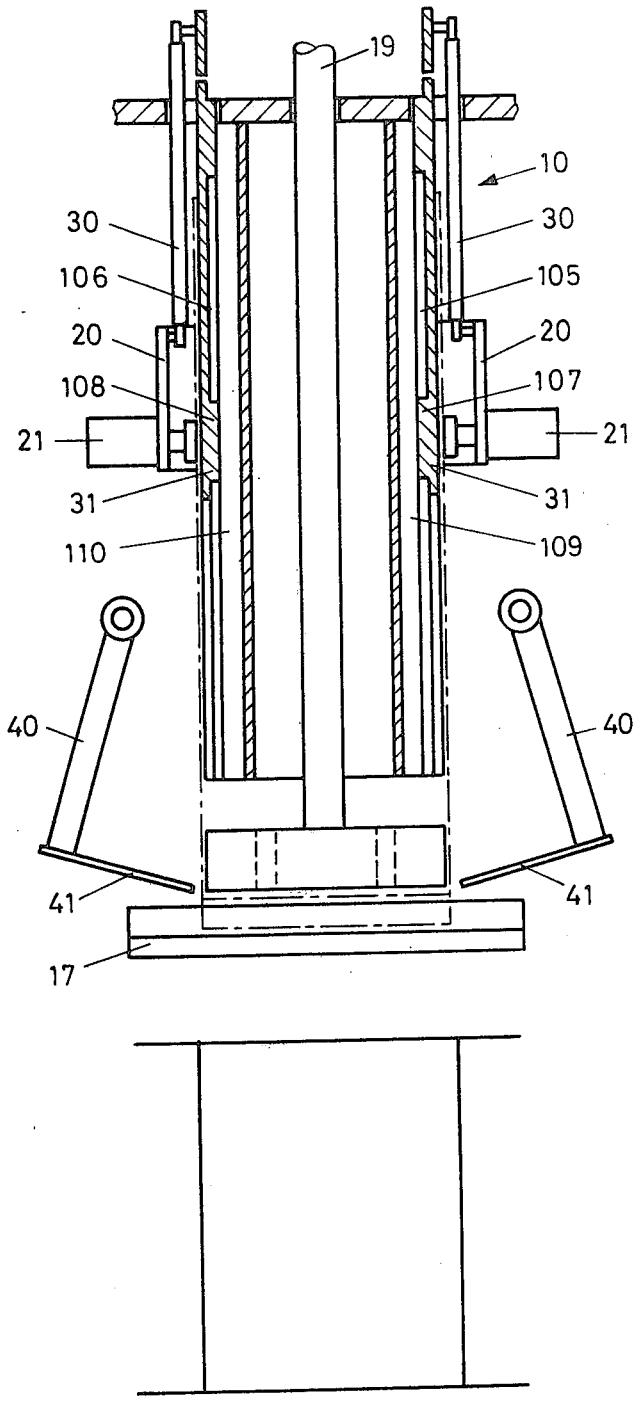
Figure 7:
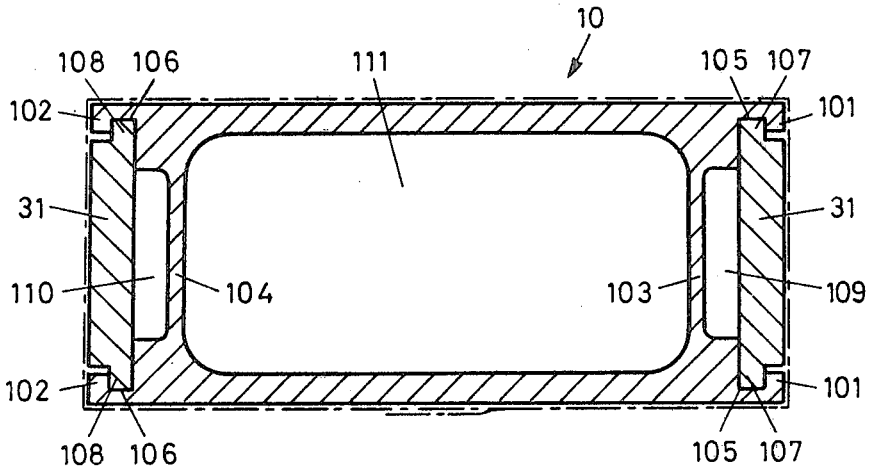
FIG. 7 is a cross-sectional view perpendicular to the longitudinal axis through the shaping mandrel of each embodiment.

Two carriages 31 are provided, as shown in FIGS. 3–7, with tongues 107 or 108 via which the carriages are mounted in grooves 105, 106 in each of two oppositely disposed side faces of the shaping mandrel 10 to be displaceable longitudinally, i.e. vertically in the plane of FIG. 1, relative to the main part of the mandrel. If the shaping mandrel is rectangular, for example, these carriages are provided in the two narrower side faces 101 and 102 as shown in FIG. 7.

The outer faces of the carriages 31, i.e. those facing away from the interior of mandrel 10, are flat and define common planes with the adjacent edge sections of the side faces 101, 102. The interior of mandrel 10 has the form of a hollow inner shaft 111 which is sealed off from the carriages 31 or the grooves 105, 106, respectively, by partitions 103 and 104. Additionally a cavity 109 or 110 is formed between the carriages 31 and each partition 103, 104.

This arrangement serves the purpose of preventing the escape of material out of the shaft 111 during filling through the shaping mandrel 10 which could soil the guide grooves and the springs. The cavities 109 and 110 serve to provide air circulation during manufacture of the bags and during removal of the bags.

Figure 2:
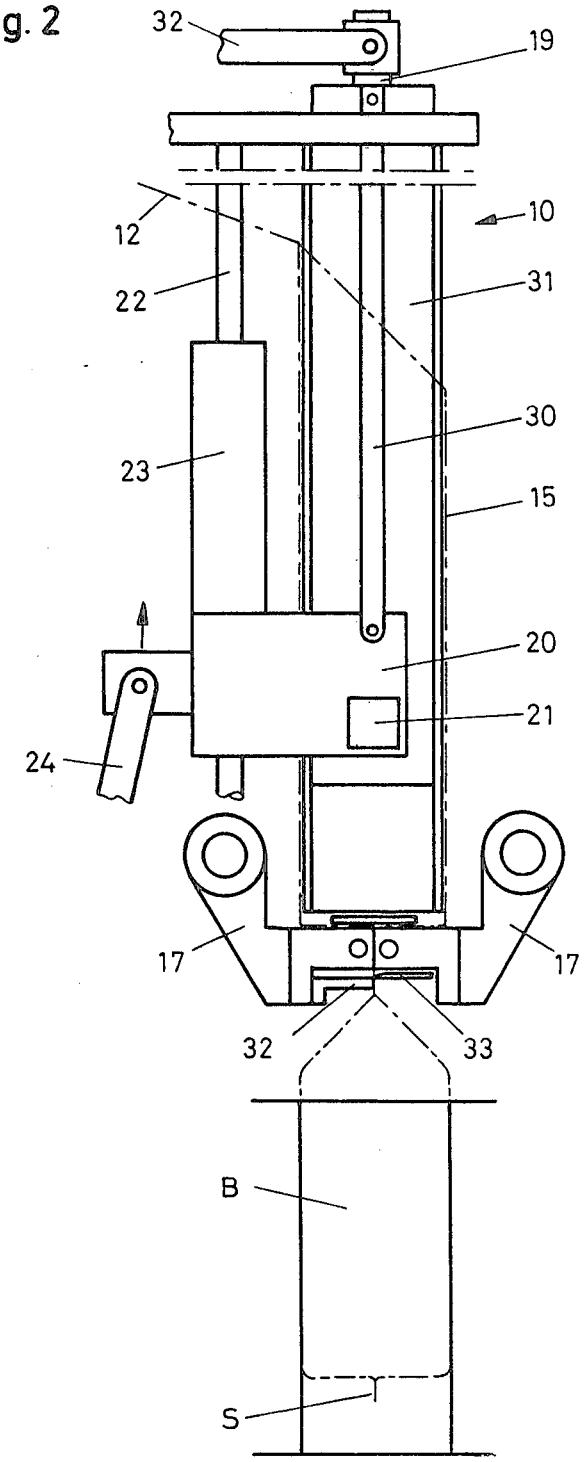
FIG. 2 is an elevational view of a portion of the embodiment of FIG. 1 but to a larger scale and showing a bag in the sealing phase.

As shown in FIGS. 1 and 2, clamping members 20 are provided outside of the tube 15 and opposite the carriages 31.

These clamping members 20 are equipped to be displaced in the axial direction of the carriages 31, i.e. vertically with respect to the view of FIGS. 1 and 2, by means of two rods 24 and 25 pivotally connected together. Rod 25 is pivotally mounted at bearing 27 fixed to the machine frame, while rod 24 is pivotally articulated to members 20. Rods 24 and 25 are pivoted in an oscillatory manner by a rotatable eccentric disc 26, while members 20 are guided during displacement by means of a guide sleeve 23 movable along a guide rod 22. The clamping members 20 and the carriages 31 are connected together by means of control rods 30, as shown in FIGS. 1–3, in such a way that the carriages 31 and the clamping members can only move vertically together in unison.

In FIG. 2, which is drawn to a larger scale than FIG. 1, there is shown also, underneath two transverse sealing jaws 17, a separating blade 33 and counter piece 32. As is customary with such devices, the two eccentric discs 26 and 34 may here be driven by the same drive motor so that synchronous operation is assured.

The mode of operation of an embodiment of the invention will now be described with reference to FIGS. 3 and 4, in which the shaping mandrel 10 is shown in cross section. The plane of FIGS. 3 and 4 is turned by 90° with respect to FIGS. 1 and 2, so that both carriages 30 can be seen as well as both clamping members 20. In addition to the elements shown in FIGS. 1 and 2, the shaping mandrel and the shaft 111, the two cavities 109 and 110, the grooves 105 and 106 and the plate-shaped thickened portions including the guide tongues 107, 108 can also be seen here. The clamping members 20 here are constituted of holding plates supporting pressing devices 21. The pressing devices 21 are pneumatically actuated pistons 210 including piston rods 211 and pressure plates 212 fastened thereto as well as retracting springs 213. Valves 50 which are actuated by eccentric discs 51 are provided for control of the pistons 210. By mechanically coupling the two eccentric discs 51, it is possible to obtain synchronous movement of the two pressing devices 21. Additionally, there are shown two gusset formers 41 and their holding arms 40.

Figure 3:
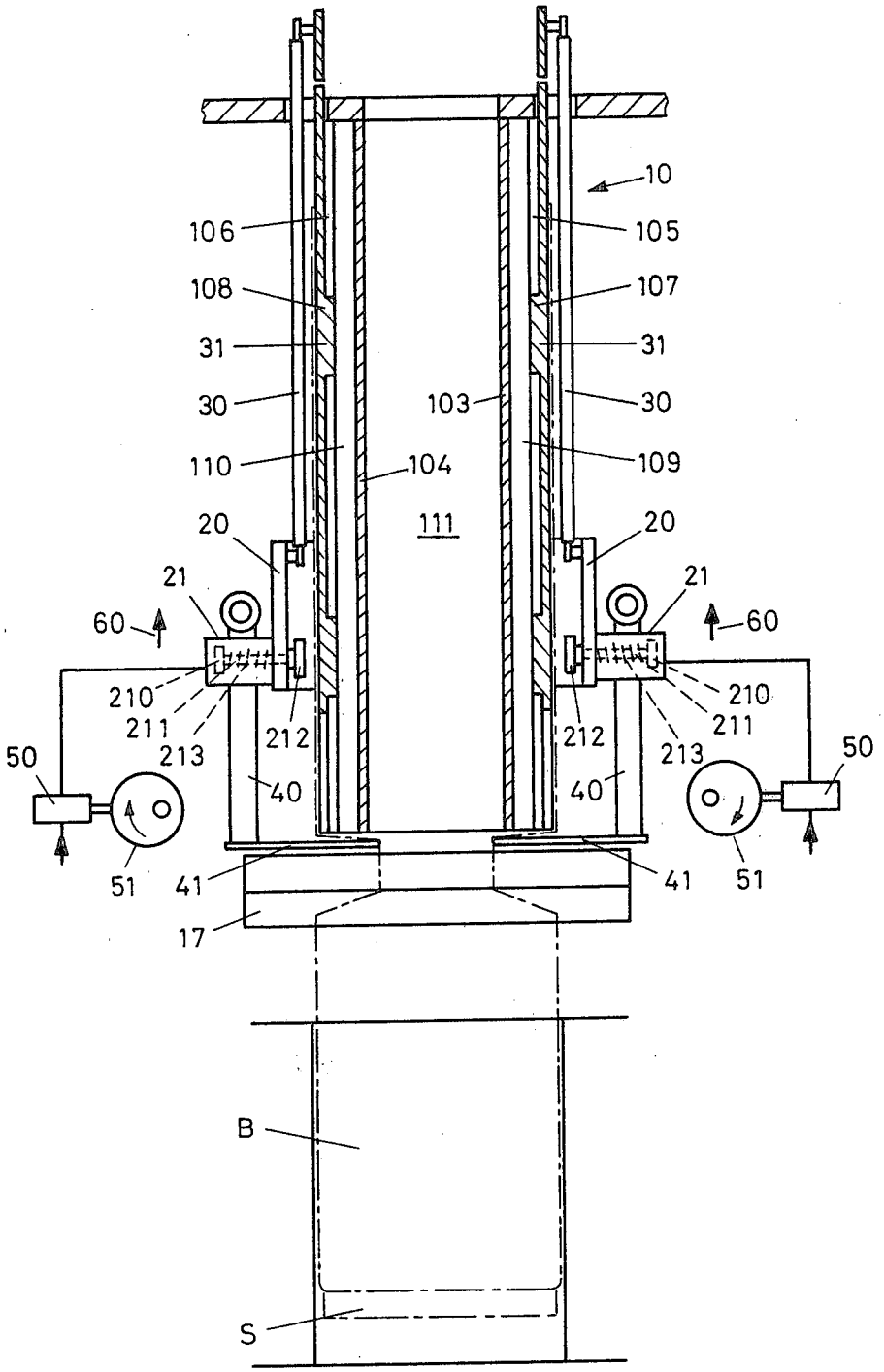
FIGS. 3 and 4 are side elevational views of the structure according to FIG. 2 in successive operating phases of tube advancement.
Figure 4:
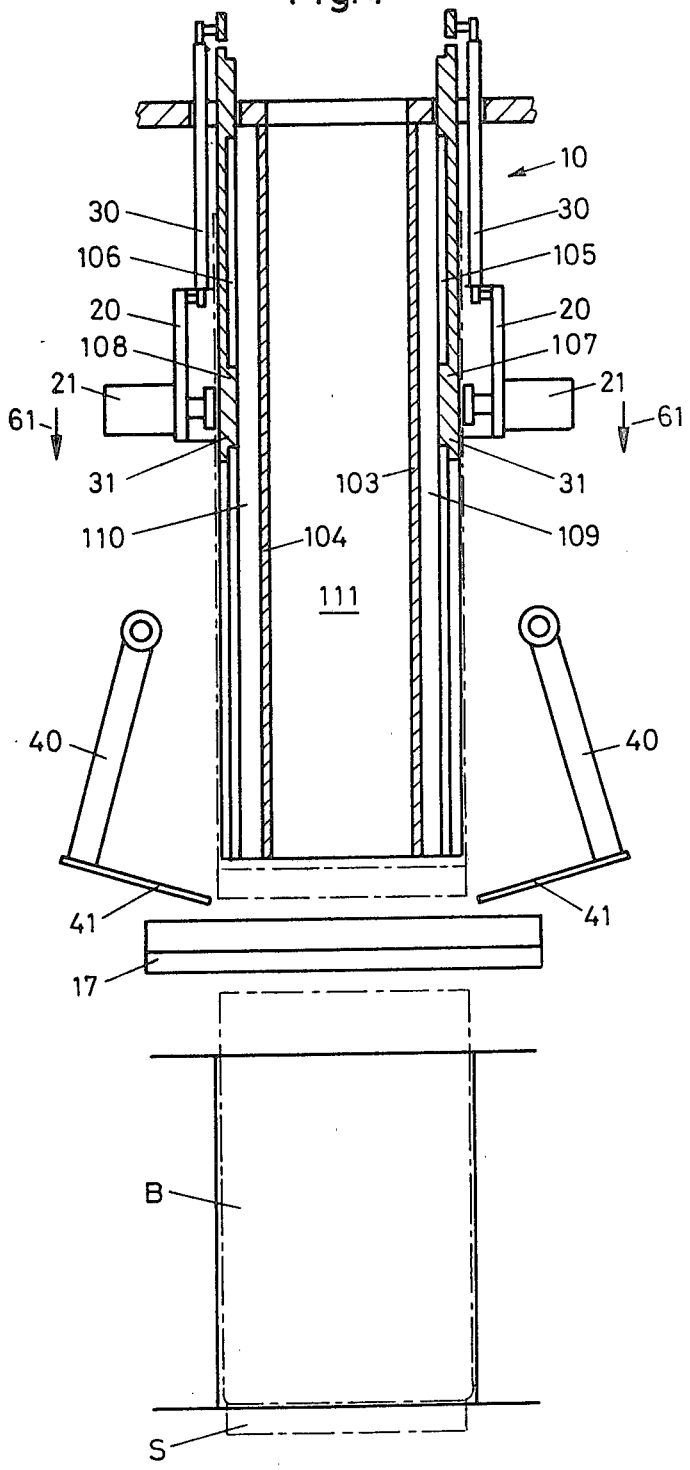

In the embodiment shown in FIG. 3, the tube 15 with a filled bag B at its end has just been moved downwardly so that the carriages 30 and the clamping members 20 are likewise in their lower end position, from which they will then move upwardly as shown by the arrows 60. The gusset formers 41 have been moved together as have the transverse sealing jaws 17 to form a bottom seam S. The pressure plates 212 of the pressure devices 21 are in their rest, or retracted, position. Now the bag B is cut off, the transverse sealing jaws 17 open and the gusset formers 41 are moved outwardly.

FIG. 4 shows this state and additionally shows the carriages 31 and the clamping members 20 in their upper end position but with the pressure plates 212 in the position where they are pressed against the carriages 31. The arrows 61 indicate the direction of subsequent movement for the carriages 21 and for the clamping members 20. When they reach their lower end position there will then again be the same configuration as shown in FIG. 3.

FIGS. 5 and 6 show a variation of the apparatus which, as in FIG. 1, is equipped with a stamp 18 and a stamping rod 19. The other components of the shaping mandrel 10, the carriage 31, clamping members 20, and pressing devices 21 with pressure plates 212 are identical with the apparatus of FIGS. 3 and 4. As known, the stamp 18 is used to shape the bottom of the bag B so that after the gusset formers 41 have formed the gusset, the folds can be sealed together.

As can easily be seen from a comparison between FIGS. 5 and 6, the stamp 18 can also be used to move a bag downwardly by a small amount after its bottom has been formed. This movement exerts a tension on the tube 15 and if the latter should adhere to the shaping mandrel along the longitudinal seam, it would be released by this tension and not by pressure on the foil as is generated by the clamping jaws together with carriages 31. The sides of the bag can therefore not be pushed together as could happen otherwise if the only active force were a pressure force.

In this apparatus no drives are required for effecting a vertical movement of the transverse sealing jaws 17 so that it is possible to increase output at reduced costs. The clamping devices 20 and the carriages 31 can be moved back, i.e. upwardly, simultaneously with the formation of the transverse seal. Thus the sealing time can be increased and the return travel time can be selected in such a way that the movement remains gentle. Thanks to the simple advancing and clamping system, the foil is advanced safely wihout any slippage. The shaping mandrel itself can also be stationarily mounted since it need not be moved and thus the drive otherwise associated therewith is also no longer necessary.

It will be understood that the above description of the present invention is susceptible to various modifications, changes and adaptations, and the same are intended to be comprehended within the meaning and range of equivalents of the appended claims.

What is claimed is:

1. In apparatus for producing bag packages and including a shaping mandrel presenting a shaping surface and a longitudinal seal forming device for forming a panel of sealable material into a tube and transverse sealing jaws and severing blades for dividing the tube into individual bags, the improvement wherein said mandrel comprises means defining two carriages mounted at diametrically opposite sides of said mandrel and forming at least in part the shaping surface of said mandrel, and said apparatus further comprises clamping members each mounted to face a respective carriage and to be moved toward said shaping mandrel to press the tube against said carriages and thus clamp the tube; and means connecting said carriages and clamping members together for movement in unison in the longitudinal direction of said mandrel.

2. Apparatus as defined in claim 1 wherein said shaping mandrel has a rectangular cross section and is provided with recesses along opposite sides thereof, and said carriages are flat plates and are disposed in said recesses.

3. Apparatus as defined in claim 2 wherein said plates are provided with tongues and said shaping mandrel is provided with corresponding guide grooves in which said tongues engage.

4. Apparatus as defined in claim 2 wherein said carriages are disposed in the two shorter sides of the rectangular cross section of said shaping mandrel.

5. Apparatus as defined in claim 1 wherein said connecting means comprise rigid displacement members carrying said clamping jaws and guided so as to be displaceable in the longitudinal direction of said mandrel.

6. Apparatus as defined in claim 5 further comprising a pneumatic drive connected for moving said clamping members toward said mandrel.

7. Apparatus as defined in claim 2 wherein said shaping mandrel has the form of a hollow prism presenting a central cavity and is provided with sealing walls located between said recesses for said carriages and said cavity.

8. Apparatus as defined in claim 7 wherein each said recess includes a portion between the respective carriage therein and the associated sealing wall, which portion defines an air channel which extends in the longitudinal direction of said mandrel.

9. Apparatus as defined in claim 1 wherein a portion of said shaping mandrel at the end thereof in the direction of advance of the panel therealong is stationarily mounted.

10. Apparatus as defined in claim 9 further comprising a stamp member located adjacent said mandrel portion, and means connected for displacing said member in the longitudinal direction of said mandrel.

* * * * *